United States Patent [19]

Nomi et al.

[11] Patent Number: 4,718,358

[45] Date of Patent: Jan. 12, 1988

[54] METHOD AND APPARATUS FOR PROCESSING WASTE MATTER

[75] Inventors: Mitsuhiko Nomi, Tokyo; Junichi Yamaji; Toyoshi Mizushima, both of Kanagawa, all of Japan

[73] Assignee: Ebara Corporation, Tokyo, Japan

[21] Appl. No.: 893,461

[22] Filed: Aug. 8, 1986

Related U.S. Application Data

[63] Continuation of Ser. No. 803,655, Nov. 29, 1985, abandoned.

[30] Foreign Application Priority Data

Dec. 25, 1984 [JP] Japan ..... 59-272066
Dec. 25, 1984 [JP] Japan ..... 59-272067
Dec. 25, 1984 [JP] Japan ..... 59-195299[U]
Dec. 25, 1984 [JP] Japan ..... 59-195300[U]

[51] Int. Cl.[4] ..... F23G 5/00; F23G 5/10; F23G 5/12

[52] U.S. Cl. ..... 110/250; 110/346

[58] Field of Search ..... 110/238, 250, 249, 237, 110/238, 346, 245

[56] References Cited

U.S. PATENT DOCUMENTS 3,818,845 6/1974 Nakane et al. ..... 110/250
4,481,891 11/1984 Takeshita et al. ..... 110/346 X
4,517,905 5/1985 Chastain et al. ..... 110/346
4,631,133 12/1986 Axelrod ..... 110/250 X

FOREIGN PATENT DOCUMENTS 148475 9/1977 Japan .
168025 12/1981 Japan .
91500 6/1982 Japan .
46899 3/1984 Japan .
44699 3/1984 Japan .
44698 3/1984 Japan .
253899 12/1985 Japan .

*Primary Examiner*—Edward G. Favors
*Attorney, Agent, or Firm*—Wenderoth, Lind & Ponack

[57] ABSTRACT

A method and an apparatus are disclosed for processing waste matter which is difficult to dispose of. The waste matter is incinerated by radiation of heat from material which exhibits microwave absorbing properties and is heated upon such absorption. The secondary gaseous waste matter produced by the incineration is burnt or pyrolysed by the presence of microwave absorbing material which is also heated by absorption of microwaves. The process according to the present invention can be practiced in an continuous operation and the volume of waste matter is remarkably reduced by the process and apparatus according to the present invention.

24 Claims, 8 Drawing Figures

METHOD AND APPARATUS FOR PROCESSING WASTE MATTER

This application is a continuation of now abandoned application Ser. No. 803,655, filed Nov. 29, 1985.

FIELD OF THE INVENTION

The present invention relates to a method and apparatus for incinerating waste matter, reducing the volume of material to be disposed of, and treating secondary waste matter by utilizing microwave energy.

BACKGROUND OF THE INVENTION

Due to rapid changes in the patterns of daily life and industrial activity and the material consumption related thereto, the volume of waste material generated by the public and by industry is increasing year by year. Several ways have been proposed for disposing of such waste matter by way of land reclamation and burning, etc. However, depending on the nature of the waste matter in question, the procedures heretofore applied are not totally suitable because of the possibility of pollution with respect to certain materials involved.

For instance, the waste matter discharged from nuclear power plants has been stored in tanks provided within the plants because of concern regarding environmental pollution. Such waste matters include spent ion exchange resins (granule or powder), spent filtering materials, spent active carbon, filters (cellulose, synthetic) and precoating material, etc. However, the volume of such waste matter being stored is increasing, and thus, it has been desired that an effective way of disposing of such waste matter be developed. To such end, it has been proposed that microwave energy be utilized in order to directly irradiate the waste matter with microwaves so as to heat and incinerate the waste matter. For example, one of such proposals is disclosed in Japanese patent application No. 109521/84.

However, if such an incinerator as above using microwave energy is employed to incinerate the waste matter referred to above, the following drawbacks are observed. That is:

(1) waste matter tends to be initially dried upon being subjected to microwave energy and this dried matter is poor in absorption of microwave energy;

(2) it is difficult to expect satisfactory incineration in a case where high molecular plastic such as ion exchange resin is subjected to incineration because a large volume of tar and unburnt carbon will be generated unless the atmospheric conditions are suitable for supplying sufficient oxygen at high temperatures;

(3) without maintaining uniform distribution of the waste matter all over the hearth and uniform radiation of microwaves on the waste matter, it would be difficult to achieve satisfactory incineration due to localized burning which may result in localized over-heating;

(4) smooth incineration would be difficult when incinerating particularly high molecule plastics since such plastics exhibit a tendency to produce an aggregated mass by melting and thus, the inside of such mass may not contact air and may merely be carbonized.

Further, a large amount of hazard gas, tar and soot, etc. would be produced within the incinerator and it would be difficult to dispose of such matter within the same incinerator unless the capacity of the incinerator were made larger than that required for the incineration and the temperature were kept relatively high;

(5) processing is restricted to a batch system and, thus, an effective continuous operation is not possible and the composition of the discharged gas may not be kept constant; and (6) construction of the incinerator is complex due to the fact that the agitator is arranged in the upper part where the microwaves are introduced, and discharge duct or waste supply are arranged and, further, air is sometimes supplied into the incinerator through the blades of the agitator.

SUMMARY OF THE INVENTION

Accordingly, it has been desired to have an improved method and apparatus of efficiently and satisfactorily disposing of waste matter including high molecule plastics and other waste matter.

It is an object of the present invention to provide a method and an apparatus for disposing of waste matter efficiently by utilizing microwave energy.

The above object is accomplished according to the present invention wherein microwave energy is directed to granules disposed on the hearth of the incinerator as a layer or bed and having excellent absorption of microwaves, so as to be heated by absorption of the microwave energy, the granules being agitated on the hearth. Upon raising the temperature of the granules to a high point such as 500° C. by this radiation, the waste matter to be incinerated is then charged continuously into the incinerator while maintaining the radiation and simultaneously supplying enough air through the bed from the bottom of the incinerator, whereby the waste matter is continuously and satisfactorily incinerated.

Further, if the secondary waste matter derived from the incineration such as gas, tar, soot, etc. is to be processed in order to reduce pollution or to keep the discharge duct clean, another furnace is provided for treatment of such secondary waste matter, again by irradiating microwaves, wherein the wall of the furnace is arranged or a bed of material is disposed in the furnace such as to exhibit the ability to absorb microwaves so as to raise the temperature thereof to a degree sufficient to be capable of burning or pyrolysing the secondary waste matter. This second furnace, if it is provided, is coupled to the incinerator in such a manner that it may receive the secondary waste matter therefrom.

It will thus be clear that the waste matter is incinerated, burnt or pyrolysed through the presence of materials which are heated by absorbing microwave energy. By using microwave energy in accordance with the present invention, difficulty in disposing of waste matter such as that, in particular, which is discharged from nuclear power plants is solved without causing any serious problem.

Further objects, effects and advantages of the present invention will become more clear when the ensuing description is reviewed with reference to the accompanying drawings, a brief explanation of which is summarized below.

DETAILED DESCRIPTION OF THE PREFERRED EMBODIMENTS

Figure 1:
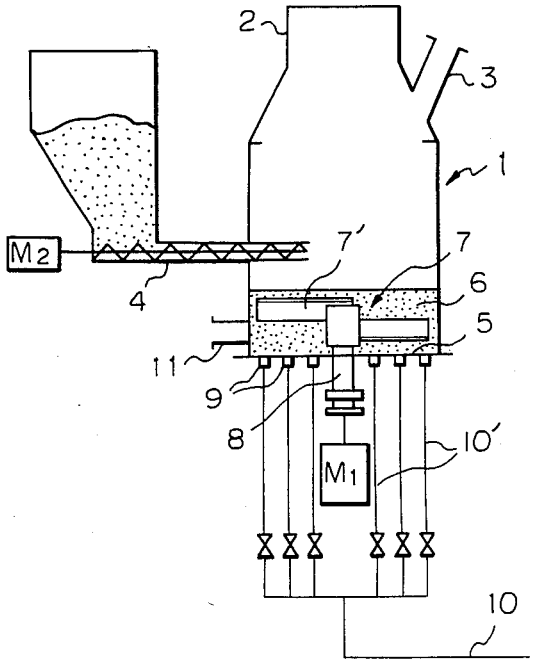
FIG. 1 is a schematic illustration of an incinerator according to the present invention.

Referring now to FIG. 1, there is schematically illustrated an incinerator 1 according to the present invention. In this drawing, 2 designates an exhaust opening for gas generated by the incineration, 3 an intake wave guide duct for introducing microwaves, 4 a feeder for supplying waste matter into the incinerator, 5 a hearth plate, 6 a layer consisting of granules exhibiting the ability to absorb microwaves, 7 an agitator, 7' an agitator blade, 8 a shaft for mounting blades 7', 9 nozzles for supplying air required for incineration, 10, 10', pipes for air supply and 11 a discharge opening for residue. $M_1$ is a motor for driving the agitator 7 through the shaft 8 and $M_2$ is a motor for driving the feeder 4.

The granules for the layer 6 are materials which exhibit properties of good absorption of microwaves and good resistance to heat and are selected from materials such as silicone carbide (SiC), titanium dioxide ($Ti0_2$), ilmenite, balium titanate ($BaTiO_3$), ferric oxide ($Fe_2O_3$), a combination of silicon carbide and silicon nitride ($SiC+Si_3N_4$), zirconium oxide ($ZrO_2$), calcium oxide (CaO) and sand, etc. Among these materials, silicon carbide, titanium dioxide, ilmenite, barium titanate and ferric oxide, particularly silicon carbide and titanium dioxide are preferred from the view point of microwave absorption properties. The size of these granules is preferably in the order of 1 to 7 mm and more preferably in the range between 2 mm and 5 mm. The thickness of the layer 6 may vary depending on the size of the agitator 7 but it is generally sufficient if it is 300 mm or more. The agitator 7 is preferably arranged so that the upper ends of the blades 7' become buried to a depth of 1 cm or more below the surface of the layer 6 when the agitator 7 is kept stationary.

For the operation of this incinerator 1, the motor $M_1$ is actuated to drive the agitator 7 and, thence, microwaves are irradiated over the layer 6 through the duct 3 so that the layer 6 of the granules will be heated by absorption of the microwaves. When the temperature of the layer 6 is raised beyond 500° C., air is supplied through nozzles 9 into the incinerator 1 and then the waste matter is supplied by the feeder 4 on the top of the layer 6 so that the waste matter is incinerated in the presence of the heated granules. Because the waste matter is supplied over the granules which have reached a high temperature, waste matter is spread over the granules. In particular, high molecular polymeric items are evenly distributed in a thin layer over the granules whereby the heating rate of these items is rapid and air uniformly supplied from the bottom efficiently contacts these items. Accordingly, in comparison with the prior art, the amount of air needing to be supplied is relatively small and thus the amount of gas generated by the incineration is also relatively small so it is easy to dispose of such generated gas. In cases where further treatment of such generated gas is required, another furnace is provided which will be explained later.

The rotational speed of the agitator 7 is preferably in the range of 5 to 20 r.p.m. but this depends on the size of the incinerator. The driving mechanism for the agitator 7 is preferably arranged in the lower part of the incinerator since, if the blade or other elements are exposed over the bed 6, such elements would act to reflect microwaves away from the target area. The blades 7' are mounted on the shaft 8 at such an angle as to reduce resistance against the layer of granules. Such angle may, for example, be less than 30° relative to the vertical axis of the shaft 8 since if such angle is made larger than, for example, 30°, such orientation of the blades will cause reflection of microwaves which is not desirable. The material of the blades is preferably, permeable to the microwaves and ceramics are one of the preferred materials for the blades 7'.

The size of the blades may vary depending on the size of the incinerator but in most cases, it is usually about 300 mm in length and about 30–80 mm in width. Also the depth of the bed is preferably around in the order of 300 mm. This also varies depending on the size of the incinerator.

With respect to the location of the agitator 7 in the lower portion of the incinerator, there is the further advantage that the construction of the upper portion of the incinerator is made relatively free in design terms and, if necessary, a secondary treating means is easily coupled thereat for processing gaseous secondary waste matter produced by the incineration.

Figure 2:
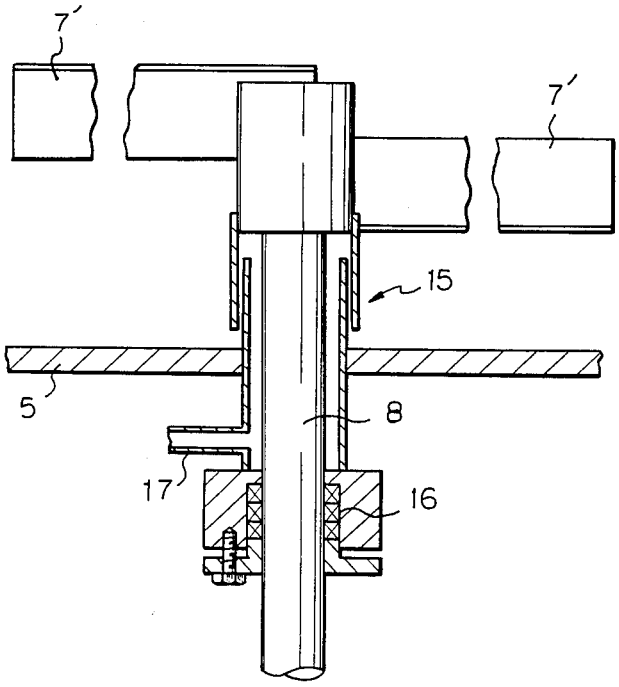
FIG. 2 is a sectional view of an agitator employed in the incinerator shown in FIG. 1.

In FIG. 2, further details of the agitator 7 are illustrated. The shaft 8 is enclosed in a baffle structure for preventing residue or other foreign materials from entering into a shaft gland seal 16, preventing microwaves from leaking out of the incinerator and providing passage for an inlet port 17 for introducing cooling air.

Figure 3:
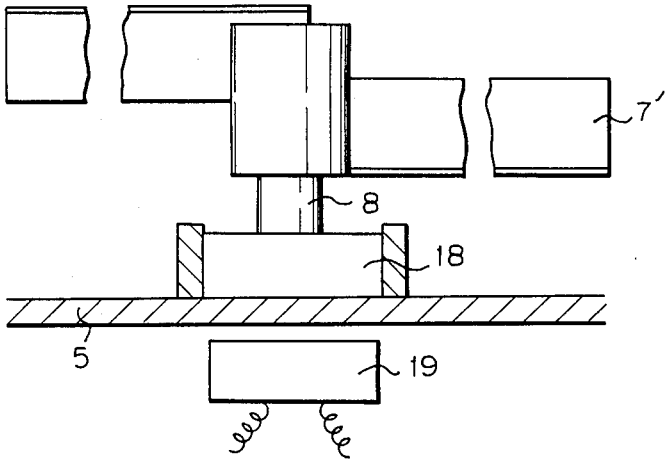
FIG. 3 is a modified example of an agitator used in the incinerator.

In order to improve the sealing effect, an alternative arrangement for the agitator is shown in FIG. 3. In FIG. 3, a rotary element 18 is attached to the lower end of the shaft and disposed on the hearth 5 so as to be rotated by a generator 19 for producing a rotary magnetic field, the generator being disposed under the hearth 5.

Figure 4:
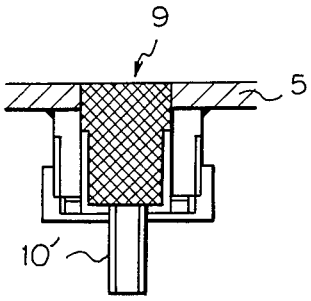
FIG. 4 is an illustration of an air nozzle arranged in a hearth plate shown in FIG. 1.

The nozzles 9 may be made in several forms suitable for supplying air into the incinerator 1. A porous ceramic pad may be one suitable for such purpose. An examplary way of installing such pad is illustrated in FIG. 4. A suitable number of nozzles or pads 9 are detachably mounted in the hearth 5 so as to uniformly supply air into the incinerator. When the pad 9 become clogged, it is replaced. Clogging may be detected by, for example, variation of the flow rate in the air supply duct 10'.

After the incinerating operation is finished, residue may be discharged outwardly together with the microwave absorbing granules through the discharge opening 11 by rotating the agitator blades 7'. The microwave absorbing granules may be returned into the incinerator 1 after being separated from the residue.

As touched upon earlier, if secondary waste matter is produced to such an extent as to require further treatment such as, for example, where the amount of exhaust gas containing harmful or combustible constituents, tar and soot, etc. is relatively large, such secondary wastes must be further burnt or pyrolysed and a furnace has been devised for treating such secondary waste matter by utilizing microwave energy. Such furnace may preferably be coupled with the exhaust opening of the incinerator. Such furnace 20 is schematically illustrated in FIG. 5.

Figure 5:
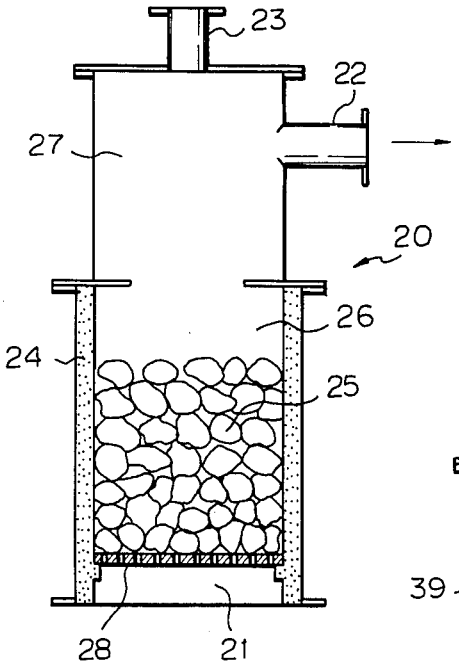
FIG. 5 is a furnace or secondary processor according to the present invention for treating the exhaust gas produced by the incineration which takes place in the incinerator.

In FIG. 5, 21 designates an inlet opening for receiving gaseous wastes into the furnace 20, 22 a discharge opening, 23 an intake duct for introducing microwaves into the furnace 20, 24 a heat insulating layer, 25 a layer consisting of granules, pieces of plate or lumps of certain materials exhibiting the ability to absorb microwaves, 26 a high temperature furnace chamber, 27 an upper chamber of the furnace and 28 a hearth plate for supporting the layer 25 and provided with a plurality of perforations permitting the passage of the exhaust gas discharged from the incinerator. The materials used for the layer are the same as those discussed in connection with the layer 6 in FIG. 1. The size of the granules for the layer 25 is preferably in the range of about 5 mm to 10 mm and the thickness of the layer 25 is preferably about 100 mm–300 mm. The hearth plate 28 may be made of microwave absorbing material in order to prevent microwaves from leaking through the inlet opening 21.

With the irradiation of the microwaves onto the layer 25, the layer is heated to a high temperature and the combustible gas and constituents of the secondary gaseous exhaust received through the intake opening 21 are heated by the layer 25 and satisfactorily burnt in the furnace chamber 26. By controlling microwaves, the layer 25 may be easily heated to a high temperature such as 900° C. or more, and it is thus possible to substantially burn tar or the like contained in the exhaust gas from the incineration of waste plastics and to pyrolyse ammonia or cyanogen, etc. contained in the same gas.

Figure 6:
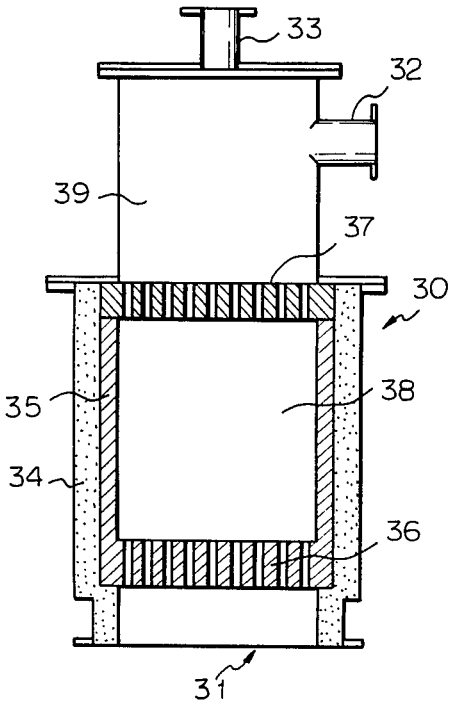
FIG. 6 is an alternative embodiment to that shown in FIG. 5.

In FIG. 6, another alternative embodiment of the furnace 30 for treating secondary gaseous waste is schematically shown. In this drawing, 31 designates an inlet opening for introducing gaseous wastes to be processed, 32 an exhaust opening, 33 an intake duct for introducing microwaves, 34 a heat insulating member, 35 a furnace wall made of microwave absorbing material, 36 a hearth plate made of microwave absorbing material and provided with passages for gaseous waste matter, 37 a perforated plate made of heat resistant and microwave permeable material for allowing passage of gas, 38 a high temperature furnace chamber and 39 an upper furnace chamber. Microwaves introduced through the duct 33 pass the perforated plate 37 and are absorbed by the wall 35 and the hearth plate 36 whereby they are heated to a high temperature and, thus, the temperature of the chamber 38 is raised to a high level by heat radiation from the wall 35 and the hearth plate 36. Therefore, gaseous secondary waste matter introduced through the inlet opening 31 into the furnace chamber 38 will be heated by the heat radiation and the combustible gas or other constituents contained therein are burnt due to the presence of oxygen which is also contained in the gaseous waste matter while other gases may be pyrolysed. The gas processed by the furnace is then discharged outwardly from the exhaust opening 32 through the upper furnace chamber 39. The perforated plate 37, which is heat resistant and permeable to microwaves, is provided so as to improve the heating efficiency by radiant heat, though it may be made out of quartz and silicon nitride, etc. or it may be made of a material containing alumina which exhibits a slight degree of absorption of microwaves.

Figure 7:
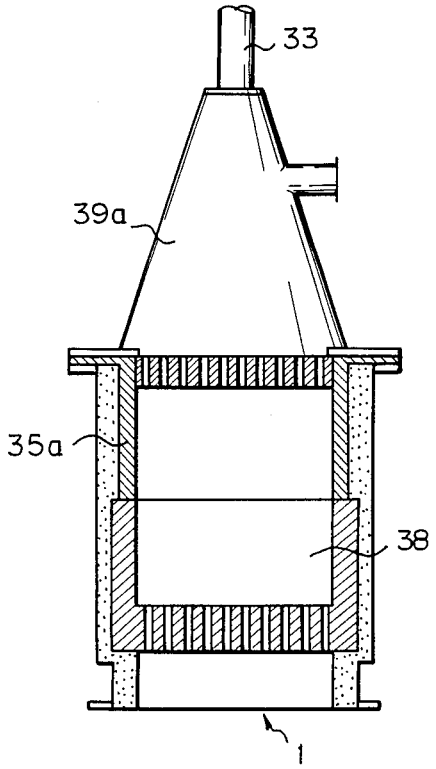
FIG. 7 is a further modification of that shown in FIG. 6.

Further improvement may be expected by shaping the upper furnace chamber 39 in FIG. 6 in the form shown as **39*a* in FIG. 7 wherein the portion near the intake duct 33 is given a taper and, with this construction, microwaves are smoothly introduced all over the furnace and reflection of the microwaves from the high temperature furnace chamber is reduced. Also, in a case where it is desired to direct a relatively large amount of microwaves towards the lower part of the high temperature furnace chamber 38 in order to promote burning efficiency by particularly raising the temperature of this part, a metallic cylinder 35*a* may be arranged at the upper wall portion of this chamber as schematically shown in FIG. 7. The metallic cylinder 35*a*** effectively reflects the microwaves to the lower part of the furnace.

Figure 8:
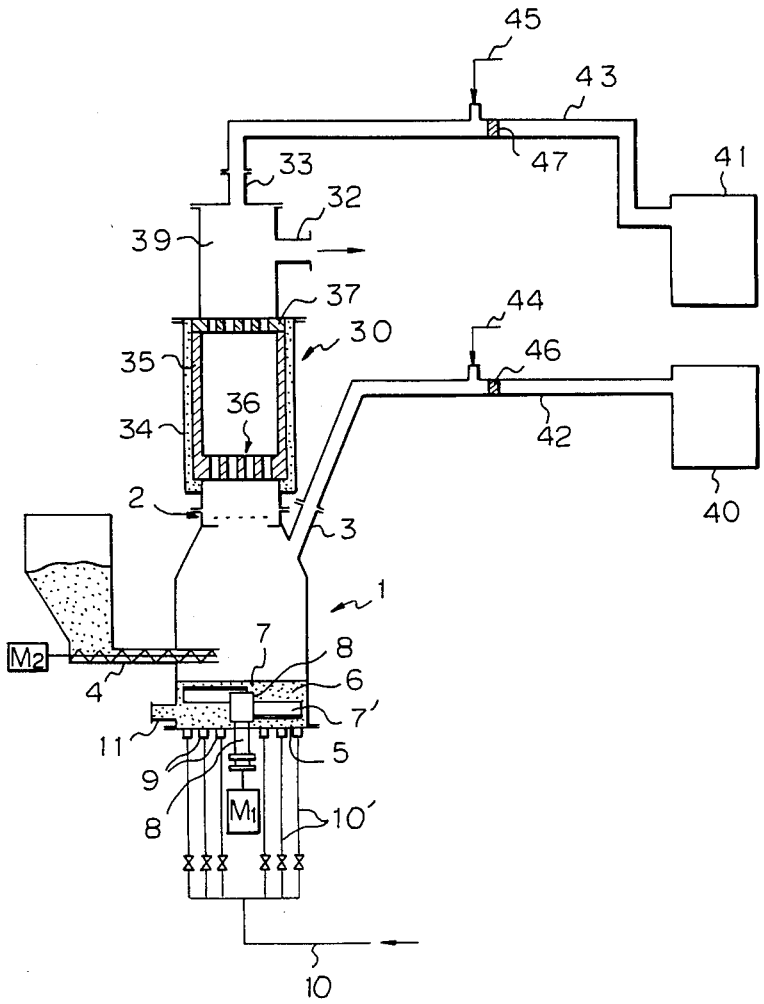
FIG. 8 shows a system for processing the incineration of the waste matter as well as treatment of the secondary gaseous waste matter generated by the incineration.

In a case where it is desired to couple the incinerator and furnace explained above, such is achieved, for example, by connecting the exhaust opening 2 of the incinerator 1 (FIG. 1) with the inlet opening 31 of the furnace 30 (FIG. 6) and such combination is schematically illustrated in FIG. 8. As discussed in connection with FIG. 1, the upper portion of the incinerator 1 is made relatively simple due to the location of the agitator, and such coupling is thus achieved quite conveniently. Most of the reference numerals in FIG. 8 are the same as those employed in FIGS. 1 and 6 and they indicate the same function as those previously used. Therefore, reference should be made to the explanation given with respect to the same reference numerals in FIGS. 1 and 6. In FIG. 8, additional reference numerals are as follows.

40, 41: microwave generator
42, 43: microwave guide
44, 45: air conduit for supplying air to microwave guide Actuation of the generators 40 and 41 generates microwaves which are directed to the incinerator 1 and the furnace 30 through the wave guides 42 and 43, respectively. The respective operations of the incinerator 1 and the furnace 30 are the same as that explained hereinbefore. In addition to the above, air is supplied to the wave guides 42 and 43 by air supplying conduits 44 and 45 so that back flow of the exhaust gas is prevented from flowing towards the generators 40 and 41. Members 46 and 47 are arranged in the wave guides 42 and 43 upstream of the inlet ports of air for the wave guides, respectively, with respect to the guiding direction of the microwaves, the members 46 and 47 being made of a material which is permeable to microwaves but impermeable to air.

It is to be noted that, in this system illustrated in FIG. 8, air necessary for the process in the furnace 30 is also supplied through the air conduit 44, wave guide 42 and inlet duct 3 into the upper portion of the incinerator 1 and such air is directed upwardly into the furnace 30.

With the arrangement shown in FIG. 8, waste matter is effectively and substantially completely processed. Thus, the incinerator 1 serves as a primary processor for incinerating the wastes and the furnace 30 serves as a secondary processor for burning and pyrolysing the gaseous secondary products generated by the incineration in the primary processor so that the gas finally discharged from the exhaust opening 32 is made relatively free from any substances which would be of concern in relation to the problem of pollution.

Employing an incinerator corresponding to that shown in FIG. 1 and a furnace corresponding to that shown in FIG. 6, tests were conducted, the data of the incinerator and furnace being given below.

| | |
|---|---|
| Incinerator: | |
| Diameter: | 350 mm |
| Height: | 1000 mm |
| Granular layer: thickness | 200 mm |
| granules | 3-4 mm of SiC |
| Furnace: | |
| Diameter: | 200 mm |
| Height: | 1000 mm |
| Microwave absorbing wall: | SiC |

A. Incineration Tests

Three different categories of waste matter were incinerated.

(1) Granular ion exchange resin

A mixture of granular cation exchange resin (strong acid: H type) and granular anion exchange resin (strong basic: OH type) was prepared in a mixing ratio of 1/1 (by volume). In order to simulate the characteristics of normal waste matter, crud material was added to the mixture in a quantity of 0.005 Kg (net Fe) per kilogram of the dried mixture. The added crud material comprised $Fe_3O_4$ and $Fe_2O_3$ in a ratio of 3/2.

The above mixture was satisfactorily and continuously incinerated under the following conditions.

Air supplied for incineration: 14 $Nm^3$/one Kg of dried granular resin

Power: 2 Kw (effective*), 2450 MHz

Incineration rate: 1.5 Kg (Dried resin)/hr.

Incineration temperature: 700°-730° C.

*Note: (Effective power)=(Supplied power)−(Reflected power)

(2) Powdered ion exchange resin

A mixture of strong acid powdered resin (H type) and strong basic powdered resin (OH type) was prepared in a mixing ratio of 2/1.

Incineration rate: 1.8 Kg dried resin/hr.

Incineration temperature: 700°-750 ° C.

Other factors were the same as (1) including the addition of crud material.

(3) Mixture of solid waste matter

A mixture of waste paper, waste cloth and plastics (rubber, polyethylene, vinyl-chrolide etc.) was prepared in a ratio of 35:35:30 by weight, respectively.

Incineration rate: 1.8 Kg/hr.

Other factors were the same as those in (1) above.

In the incineration tests, it was observed that, if the amount of material charged into the incinerator was increased, the incineration temperature remained at over 650° C. even if the irradiation of microwaves was stopped due to the self thermal calory produced by the matter incinerated. For instance, ion exchange resin produces about 6500° Kcal/Kg when it is incinerated. After burning granular ion exchange resin, it was found that the weight of the resultant residue was reduced to 1/150 to 1/200 of the original weight of the resin.

B. Exhaust Gas Treating (Burning/Pyrolysing)

The gas generated by the incineration was processed by the furnace which was installed at the top of the incinerator as schematically shown in FIG. 8.

The exhaust gas generated by the test A-(1) was processed by the furnace under the conditions summarized below.

| | |
|---|---|
| Gas supply: | 14 $Nm^3$/hr. |
| Air supply: | 11 $Nm^3$/hr. |
| Gas discharged: | 25 $Nm^3$/hr. |
| Temperature of furnace: | about 950° C. |
| Power of microwaves: | 6.1 Kw (effective) |
| Supplied gas composition (unit: ppm) | |
| Tar | 30-50 |
| Unburnt carbon | 1000-1400 |
| CO | 800-1500 |
| $H_2S$ | under 50 |
| $SO_2$ | 4200 |
| $NH_3$ | 15-20 |
| HCN | under 10 |
| $NO_x$ | 500-800 |

After passing through the furnace, the composition of the discharged gas became as follows. (ppm)

| | |
|---|---|
| Tar | none detectable |
| Unburnt carbon | under 50 |
| CO | under 100 |
| $H_2S$ | none detectable |
| $SO_2$ | 2300 |
| $NH_3$ | none detectable |
| HCN | none detectable |
| $NO_x$ | 220-250 |

From the foregoing description, it would have become clear that the present invention provides a method and apparatus for disposing of waste matter satisfactorily by employing microwave energy, which method and apparatus facilitate control of the operation due to the employment of microwaves.

The present invention has been explained in detail with reference to particular embodiments but it should be understood that modifications and changes are available to those skilled in the art within the sprit and scope of the present invention defined in the claims appended hereto.

What is claimed is:

1. A method of incinerating waste matter by employing an incinerator comprising the steps of:

irradiating microwaves onto a bed consisting of granules which are kept under agitation, said granules being made of material exhibiting the characteristics of good absorption of microwaves so that the granules are heated by such absorption; and continuously charging said waste matter on said layer heated by the radiation of microwaves.

2. A method as claimed in claim 1 wherein said waste matter falls within at least one of the following categories either independently or in a combination thereof, spent ion exchange resin (granular/powdered), spent active carbon, fibrous material and pre-coating material, etc.

3. A method as claimed in claim 1 wherein said granules are made of carbide of metallic or non-metallic material, oxide of metallic or non-metallic material or a complex thereof.

4. A method as claimed in claim 3 wherein said granules are made of silicon carbide or titanium oxide.

5. A method for processing gaseous waste matter which includes a combustible constituent and/or a harmful constituent, the method comprising the steps of:

heating a furnace containing microwave absorbing material by irradiating microwaves thereinto; and passing said gaseous waste matter through said furnace thereby burning said combustible constituent and/or pyrolysing said harmful constituent.

6. A method as claimed in claim 5 wherein said microwave absorbing material is spread as a bed of granules in said furnace.

7. A method as claimed in claim 5 wherein said microwave absorbing material is disposed as an internal wall of said furnace.

8. A method as claimed in claim 5 wherein said microwave absorbing material is a carbide of metallic or non-metallic material, oxide of metallic or non-metallic material or a complex thereof.

9. A method as claimed in claim 5 wherein said microwave absorbing material is silicon carbide or titanium oxide.

10. A method of disposing of waste matter comprising the steps of:

irradiating microwaves onto a bed arranged within an incinerator and consisting of granules which are kept under agitation, said granules being made of material exhibiting the characteristic of good absorption of microwaves so that the granules are heated by such absorption;

irradiating microwaves onto a microwave absorbing wall of a furnace coupled to an exhaust opening of said incinerator so that the temperature of the furnace becomes high;

charging said waste matter continuously into said incinerator so that it is incinerated in said furnace; and passing exhaust gas produced in said incinerator by the incineration through said furnace thereby burning combustible constituents of the exhaust gas and pyrolysing harmful constituents of the exhaust gas.

11. An apparatus for incinerating waste matter comprising:

an incinerator body;

a feeder for continuously charging said waste matter into said incinerator body;

a bed of granules made of microwave absorbing material and disposed on a hearth of said incinerator;

an agitator for agitating said bed which is driven by a driver arranged below the hearth;

a plurality of nozzles arranged on said hearth and coupled to an air source for supplying air into said body; and a microwave guide for introducing microwaves into said body.

12. An apparatus as claimed in claim 11 wherein said nozzles comprise a plurality of porous ceramic pads.

13. An apparatus for processing gaseous waste matter comprising:

a furnace body having an inlet opening at the bottom and an exhaust opening at the upper portion thereof;

a non-fusible microwave absorbing material disposed within said furnace body; and a microwave guide coupled with said body for introducing microwaves into said body.

14. An apparatus as claimed in claim 13 wherein said microwave absorbing material is a layer of granules, pieces of plate or lumps disposed at the lower portion of said furnace body.

15. An apparatus as claimed in claim 13 wherein said microwave absorbing material is disposed as an inner side wall and a perforated bottom plate of said furnace body.

16. An apparatus as claimed in claim 13 wherein the inside of said furnace body is divided into a high temperature furnace chamber and an upper chamber communicating with said high temperature furnace chamber, said microwave absorbing material being disposed in said high temperature furnace chamber, and said wave guide and said exhaust opening being communicated with said upper chamber.

17. An apparatus as claimed in claim 16 wherein said microwave absorbing material is disposed as an internal side wall and a perforated bottom plate in said high temperature furnace chamber.

18. An apparatus as claimed in claim 17 wherein a perforated plate made of a material permeable to microwaves is disposed between said upper chamber and said high temperature furnace chamber.

19. An apparatus as claimed in claim 17 wherein an upper portion of the side wall of said high temperature furnace chamber is covered by metal plate so as to reflect microwaves.

20. An apparatus as claimed in claim 18 wherein said upper chamber is given a downwardly enlarging taper.

21. An apparatus for processing waste matter comprising:

an incinerator body having an exhaust opening;

a feeder for continuously charging said waste matter into said incinerator body;

a bed of granules made of microwave absorbing material and disposed on a hearth of said incinerator;

an agitator for agitating said bed which is driven by a driver arranged below the hearth;

a plurality of nozzles disposed on said hearth and coupled to an air source for supplying air into said body;

a microwave guide for introducing microwaves into said body;

a furnace body having an inlet opening at the bottom and an exhaust opening at the upper portion thereof, said inlet opening being coupled with said exhaust opening of said incinerator body;

microwave absorbing material disposed within said furnace body; and a microwave guide coupled with said body for introducing microwaves into said furnace body.

22. An apparatus as claimed in claim 21 wherein said microwave absorbing material disposed within said furnace is a layer of granules, pieces of plate or lumps disposed at the lower portion of said furnace body.

23. An apparatus as claimed in claim 21 wherein said microwave absorbing material is disposed as an inner side wall and a perforated bottom plate of said furnace body.

24. An apparatus as claimed in claim 19 wherein said upper chamber is given a downwardly enlarging taper.

* * * * *